US011692464B2

(12) United States Patent
Fukuyama et al.

(10) Patent No.: US 11,692,464 B2
(45) Date of Patent: Jul. 4, 2023

(54) VALVE TIMING ADJUSTMENT DEVICE

(71) Applicant: DENSO CORPORATION, Kariya (JP)

(72) Inventors: Tomoyuki Fukuyama, Kariya (JP); Tetsuro Mitsutani, Kariya (JP)

(73) Assignee: DENSO CORPORATION, Kariya (JP)

( * ) Notice: Subject to any disclaimer, the term of this patent is extended or adjusted under 35 U.S.C. 154(b) by 40 days.

(21) Appl. No.: 17/408,773

(22) Filed: Aug. 23, 2021

(65) Prior Publication Data

US 2021/0381402 A1 Dec. 9, 2021

Related U.S. Application Data

(63) Continuation of application No. PCT/JP2020/006174, filed on Feb. 18, 2020.

(30) Foreign Application Priority Data

Feb. 28, 2019 (JP) ..... 2019-035107

(51) Int. Cl.
*F01L 1/344* (2006.01)

(52) U.S. Cl.
CPC ... *F01L 1/3442* (2013.01); *F01L 2001/34426* (2013.01); *F01L 2001/34479* (2013.01)

(58) Field of Classification Search
CPC ..... F01L 1/3442; F01L 2001/34426; F01L 2250/02; F01L 2303/01; F01L 1/053; F01L 2001/34479; F01L 2001/0537; F01L 2001/34433
USPC ..... 123/90.15
See application file for complete search history.

(56) References Cited

U.S. PATENT DOCUMENTS

| | | | | |
|---|---|---|---|---|
| 5,520,145 | A | 5/1996 | Nagai et al. | |
| 6,439,184 | B1 * | 8/2002 | Takenaka | F01L 1/34 123/90.17 |
| 9,151,188 | B2 * | 10/2015 | Hayashi | F01L 1/344 |
| 2011/0174252 | A1 * | 7/2011 | Tada | F01L 1/024 123/90.15 |
| 2018/0283228 | A1 | 10/2018 | Sakakibara et al. | |
| 2019/0162084 | A1 * | 5/2019 | Bohner | F01L 1/3442 |

FOREIGN PATENT DOCUMENTS

| | | | |
|---|---|---|---|
| JP | 7-233743 | 9/1995 | |
| JP | H11-229828 | 8/1999 | |
| JP | 2016-044652 | 4/2016 | |
| JP | 2016044652 A * | 4/2016 | F01L 1/344 |

* cited by examiner

*Primary Examiner* — Devon C Kramer
*Assistant Examiner* — Kelsey L Stanek
(74) *Attorney, Agent, or Firm* — Nixon & Vanderhye P.C.

(57) ABSTRACT

A valve timing adjustment device includes: a housing member; a vane rotor that includes vanes and is securely coupled to a driven shaft and is rotatable relative to the housing member when the vane rotor receives a pressure of hydraulic oil introduced into hydraulic chambers; a fixing member that fixes the vane rotor to the driven shaft; and a bearing section that rotatably supports the housing member. The housing member includes a winding section that is formed at an outer peripheral surface of the housing member. A transmission member is wound around the winding section. The bearing section and the winding section at least partially overlap with each other when viewed in a direction perpendicular to an axial direction.

11 Claims, 9 Drawing Sheets

VALVE TIMING ADJUSTMENT DEVICE

CROSS REFERENCE TO RELATED APPLICATIONS

This application is a continuation application of International Patent Application No. PCT/JP2020/006174 filed on Feb. 18, 2020, which designated the U.S. and claims the benefit of priority from Japanese Patent Application No. 2019-35107 filed on Feb. 28, 2019. The entire disclosures of all of the above applications are incorporated herein by reference.

TECHNICAL FIELD

The present disclosure relates to a valve timing adjustment device.

BACKGROUND

Previously, a valve timing adjustment device, which adjusts a valve timing of intake valves or exhaust valves of an internal combustion engine, has been used. One previously proposed valve timing adjustment device is placed in a drive force transmission path extending from a crankshaft (drive shaft) to a camshaft (driven shaft) and adjusts the valve timing by adjusting a relative rotational phase between these shafts. This valve timing adjustment device includes: a vane rotor that is installed to an end part of the camshaft; a housing member that receives the vane rotor and forms hydraulic chambers, each of which is partitioned into an advance hydraulic chamber and a retard hydraulic chamber by the vane rotor received in the housing member; a hydraulic oil control valve that fixes both of the vane rotor and the housing member to the camshaft and controls supply and discharge of hydraulic oil relative to the advance hydraulic chambers and the retard hydraulic chambers; and a bushing member that is placed between the hydraulic oil control valve and the housing member and rotatably supports the housing. A winding section, around which a timing chain is wound, is formed at an outer peripheral surface of the housing member, and the timing chain is wound around the winding section and the crankshaft to transmit a drive force from the crankshaft to the camshaft.

SUMMARY

This section provides a general summary of the disclosure, and is not a comprehensive disclosure of its full scope or all of its features.

According to one aspect of the present disclosure, there is provided a valve timing adjustment device configured to be fixed to an end part of a driven shaft to adjust a valve timing of a valve by adjusting a relative rotational phase of the driven shaft relative to a drive shaft, wherein the driven shaft is configured to receive a drive force from the drive shaft to open and close the valve. The valve timing adjustment device includes: a housing member that has an inside space and is configured to receive the drive force from the drive shaft; a vane rotor that includes at least one vane which partitions the inside space into a plurality of hydraulic chambers, wherein the vane rotor is securely coupled to the driven shaft and is configured to rotate relative to the housing member when the vane rotor receives a pressure of the hydraulic oil introduced into at least one of the plurality of hydraulic chambers; a fixing member that fixes the vane rotor to the driven shaft; and a bearing section that is placed between the housing member and the fixing member in a radial direction and rotatably supports the housing member. The housing member includes a winding section that is formed at an outer peripheral surface of the housing member, wherein a transmission member, which is configured to transmit the drive force from the drive shaft toward the driven shaft, is wound around the winding section. The bearing section and the winding section at least partially overlap with each other when viewed in a direction perpendicular to an axial direction of the fixing member.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
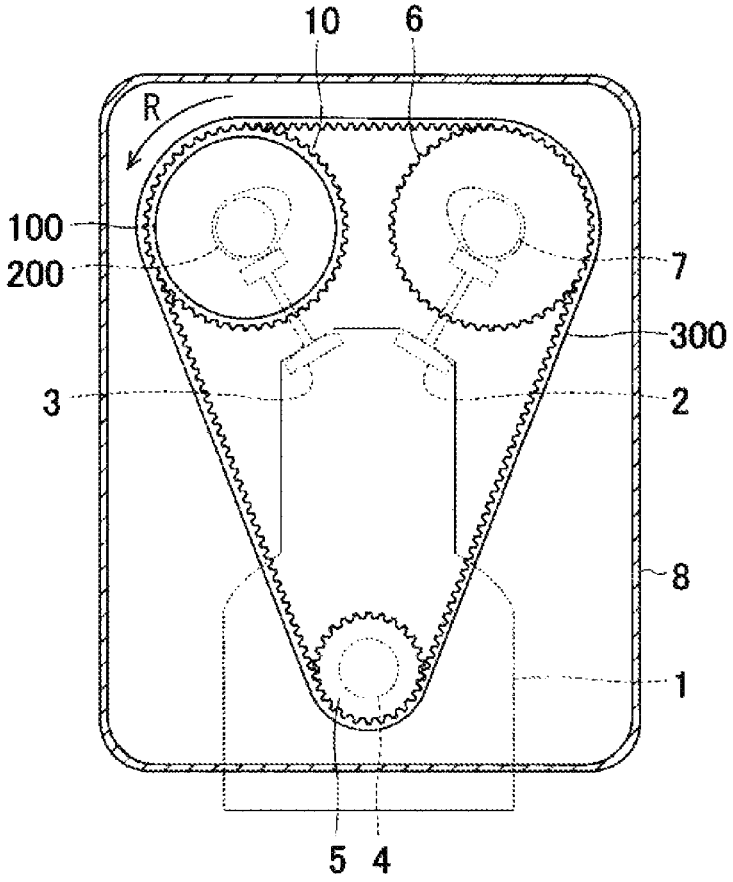
FIG. 1 is a schematic diagram of a drive force transmission system of an engine in which a valve timing adjustment device of one embodiment of the present disclosure is applied.

Previously, a valve timing adjustment device, which adjusts a valve timing of intake valves or exhaust valves of an internal combustion engine, has been used. One previously proposed valve timing adjustment device is placed in a drive force transmission path extending from a crankshaft (drive shaft) to a camshaft (driven shaft) and adjusts the valve timing by adjusting a relative rotational phase between these shafts. This valve timing adjustment device includes: a vane rotor that is installed to an end part of the camshaft; a housing member that receives the vane rotor and forms hydraulic chambers, each of which is partitioned into an advance hydraulic chamber and a retard hydraulic chamber by the vane rotor received in the housing member; a hydraulic oil control valve that fixes both of the vane rotor and the housing member to the camshaft and controls supply and discharge of hydraulic oil relative to the advance hydraulic chambers and the retard hydraulic chambers; and a bushing member that is placed between the hydraulic oil control valve and the housing member and rotatably supports the housing. A winding section, around which a timing chain is wound, is formed at an outer peripheral surface of the housing member, and the timing chain is wound around the winding section and the crankshaft to transmit a drive force from the crankshaft to the camshaft.

In the above-described valve timing adjustment device, the winding section is displaced from a bearing section of the bushing member in the axial direction when viewed in the radial direction. More specifically, the winding section (timing sprocket) is displaced from the bearing section of the bushing member (biasing unit) toward the camshaft in the axial direction when viewed in the radial direction. In the above structure, in which the winding section and the bearing section are displaced from each other in the axial direction in the view taken in the radial direction, when the tension of the timing chain is applied to the winding section, a force is applied to the housing member to tilt the housing member. Therefore, a large thrust force is applied from the housing member to the vane rotor in the axial direction. When the large thrust force is applied to the vane rotor, a frictional force between the housing member and the vane rotor is increased to possibly cause a reduction in a response speed and an increase in the amount of wear at the housing member and the vane rotor. The above disadvantages are not limited to the timing chain but also commonly occur in a structure where a transmission member, such as a belt, is used. Therefore, it is desired to develop a technology that can limit the generation of the thrust force between the housing member and the vane rotor in the valve timing adjustment device.

The present disclosure can be implemented as follows.

According to one aspect of the present disclosure, there is provided a valve timing adjustment device configured to be fixed to an end part of a driven shaft to adjust a valve timing of a valve by adjusting a relative rotational phase of the driven shaft relative to a drive shaft, wherein the driven shaft is configured to receive a drive force from the drive shaft to open and close the valve. The valve timing adjustment device includes: a housing member that has an inside space and is configured to receive the drive force from the drive shaft; a vane rotor that includes at least one vane which partitions the inside space into a plurality of hydraulic chambers, wherein the vane rotor is securely coupled to the driven shaft and is configured to rotate relative to the housing member when the vane rotor receives a pressure of the hydraulic oil introduced into at least one of the plurality of hydraulic chambers; a fixing member that fixes the vane rotor to the driven shaft; and a bearing section that is placed between the housing member and the fixing member in a radial direction and rotatably supports the housing member. The housing member includes a winding section that is formed at an outer peripheral surface of the housing member, wherein a transmission member, which is configured to transmit the drive force from the drive shaft toward the driven shaft, is wound around the winding section. The bearing section and the winding section at least partially overlap with each other when viewed in a direction perpendicular to an axial direction of the fixing member.

According to the valve timing adjustment device of the above aspect, since the bearing section and the winding section at least partially overlap with each other when viewed in the direction perpendicular to the axial direction of the fixing member, it is possible to limit the application of the force to the housing member in the direction for tilting the housing member when the tension of the transmission member is applied to the winding section. As a result, it is possible to limit the generation of the thrust force between the housing member and the vane rotor.

The present disclosure can be implemented in various forms which are other than the valve timing adjustment device. For example, the present disclosure may be implemented in a form of a vehicle equipped with the valve timing adjustment device, a valve timing adjustment method, a computer program for realizing the method, a storage medium storing the computer program, and the like.

Hereinafter, an embodiment of the present disclosure will be described with reference to the drawings.

A. Overall Structure

As shown in FIG. 1, a valve timing adjustment device 100 according to the embodiment of the present disclosure is applied to a drive force transmission system of an engine 1. In the drive force transmission system, a belt 300 is wound around a pulley 5 fixed to a crankshaft (serving as a drive shaft) 4 of the engine 1 and two pulleys 6, 10 respectively fixed to two camshafts (serving as driven shafts) 7, 200, and a drive force is transmitted from the crankshaft 4 to the camshafts 7, 200 through the belt 300. The camshaft 200 drives a plurality of intake valves 3. The camshaft 7 drives a plurality of exhaust valves 2. Each of the camshafts 7, 200 is shaped generally in a cylindrical rod form.

The pulley 10 forms a part of the valve timing adjustment device 100 and receives the drive force from the crankshaft 4 through the belt 300 as described above. Furthermore, a vane rotor 20 of the valve timing adjustment device 100 is securely coupled to the camshaft 200. The valve timing adjustment device 100 adjusts a relative rotational phase of the camshaft 200 relative to the crankshaft 4 by adjusting a relative rotational phase of the vane rotor 20 relative to the pulley 10. Thereby, a valve timing, which is a timing for opening and closing the intake valves 3, is adjusted.

A belt cover 8 is installed such that the belt cover 8 entirely covers each pulley 5, 6, 10 and the belt 300. The belt cover 8 limits adhesion of hydraulic oil and lubricating oil (described later) to the belt 300. An arrow R in FIG. 1 indicates a turning direction of the belt 300.

B. Detailed Structure of Valve Timing Adjustment Device

Figure 2:
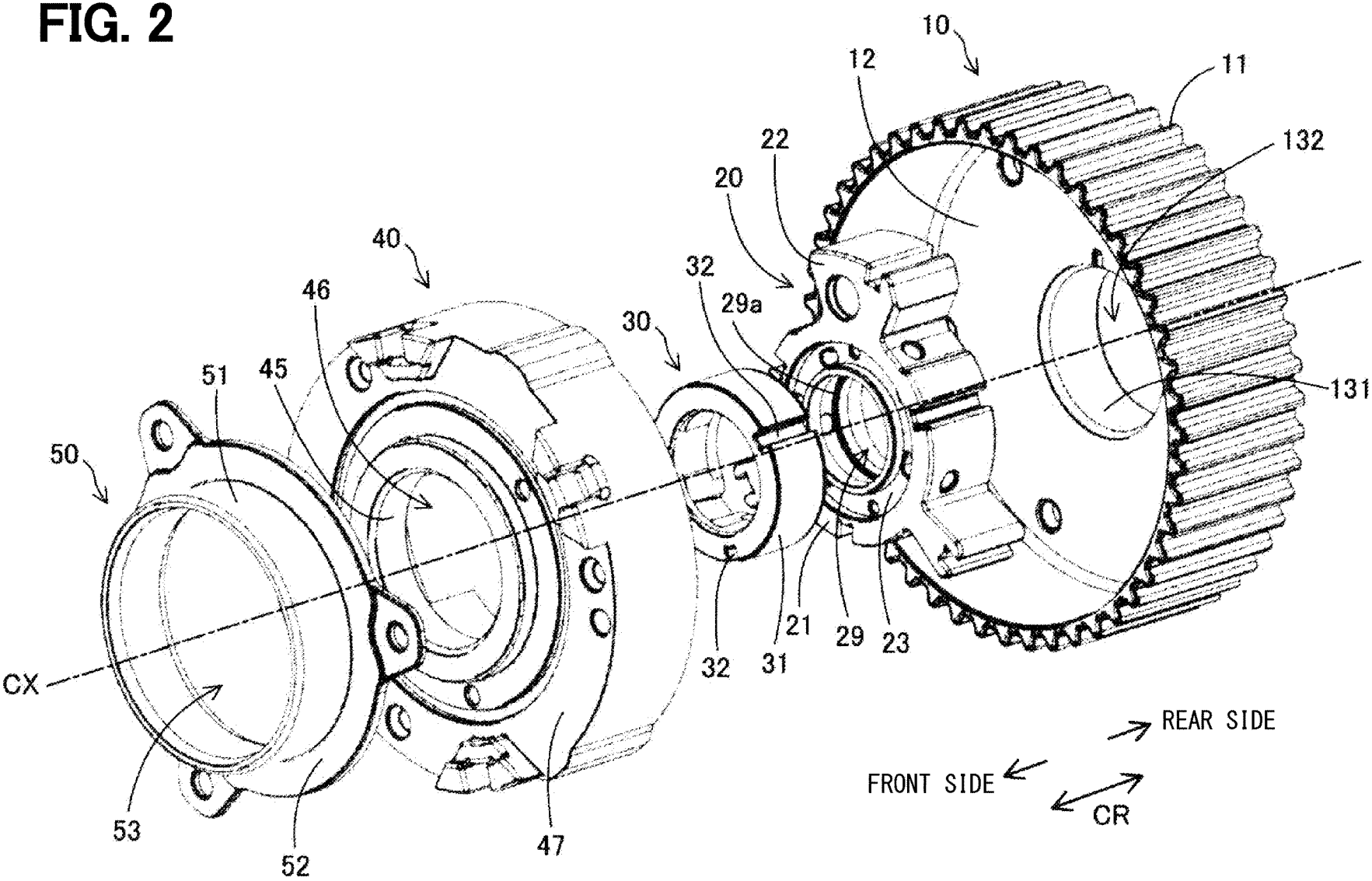
FIG. 2 is an exploded perspective view of some of components of the valve timing adjustment device.

As shown in FIG. 2, the valve timing adjustment device 100 includes the pulley 10, a housing vane 40, the vane rotor 20, a bushing member 30 and a front plate 50. The pulley 10, the housing vane 40, the vane rotor 20, the bushing member 30 and the front plate 50 respectively serve as a rotatable body and has a rotational axis that coincides with an axis CX. In the present embodiment, a direction, which is parallel with the axis CX, will be referred to as an axial direction CR. Furthermore, a side of the valve timing adjustment device 100, at which the camshaft 200 is placed in the axial direction, will be referred to as a rear side, and another side of the valve timing adjustment device 100, which is opposite to the rear side in the axial direction, will be referred to as a front side. FIG. 2 indicates only some of main components of the valve timing adjustment device 100 in an exploded state and does not indicate some of components, such as a hydraulic oil control valve 60, bolts 19 and seal members 411, 412 for the sake of simplicity.

Figure 3:
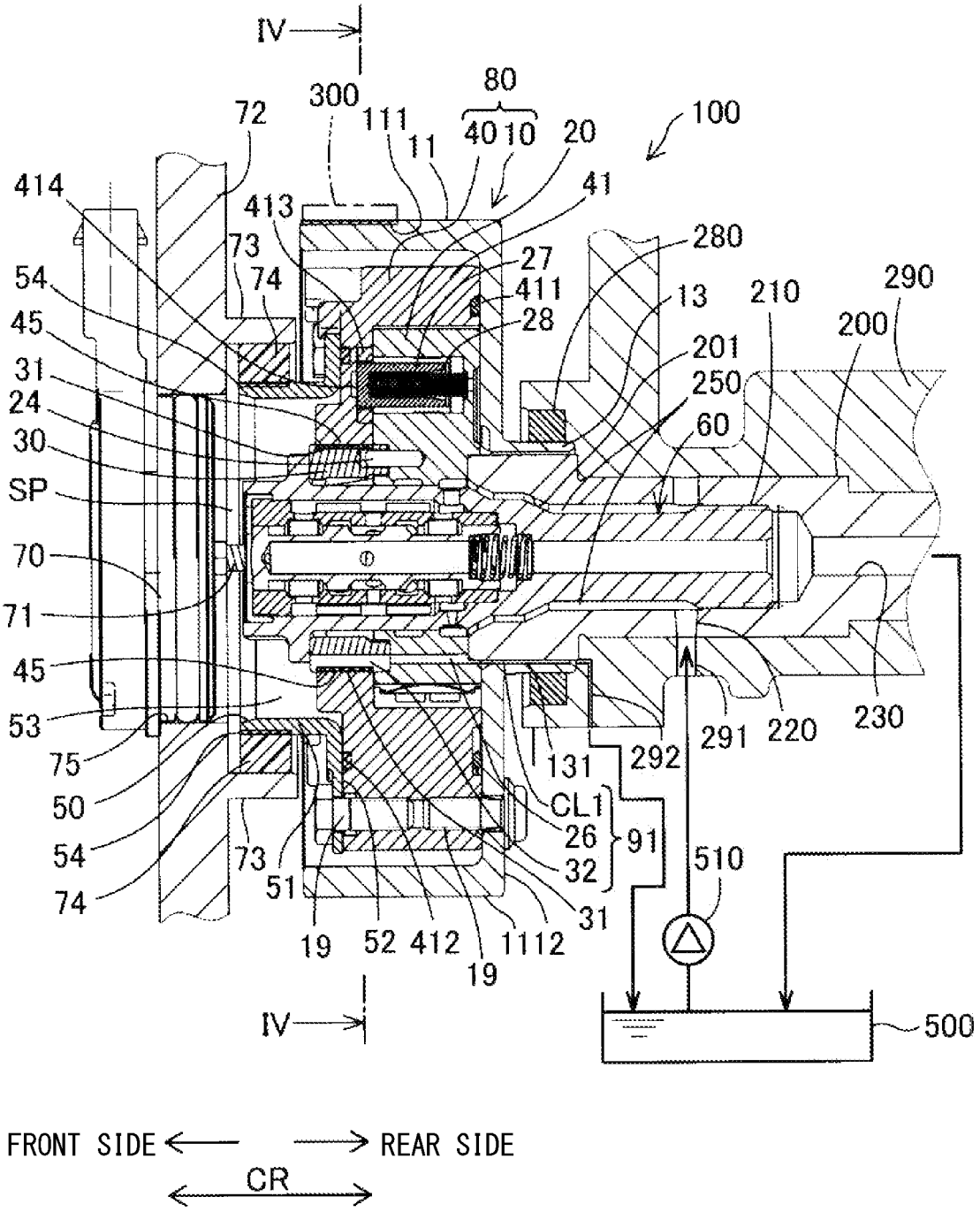
FIG. 3 is a cross-sectional view of the valve timing adjustment device taken along line III-III in FIG. 5.

In FIG. 3, a solenoid device 70, a solenoid device cover 72, and a rear cover 290 are indicated in addition to the valve timing adjustment device 100 and the camshaft 200. Furthermore, in FIG. 3, indication of the belt cover 8 shown in FIG. 1 is omitted. The solenoid device 70 includes a push pin 71 and drives the push pin 71 in the axial direction CR by using an electromagnetic force generated upon energization from an undepicted electronic control unit (ECU). The solenoid device cover 72 has a through-hole 75 that receives a portion of the solenoid device 70 which is located on the rear side. Furthermore, the solenoid device cover 72 has an enclosing portion 73 which is formed around the through-hole 75 such that the enclosing portion 73 is shaped in a tubular form and projects toward the rear side. The rear cover 290 circumferentially entirely surrounds a front side end part of the camshaft 200.

[B1. Structure of Pulley]

As shown in FIGS. 2 and 3, the pulley 10 is shaped generally in a bottomed tubular form. The pulley 10 includes an externally toothed portion 11 shaped in a tubular form, a flange portion 12 and a tubular portion 13. In the present embodiment, the externally toothed portion 11, the flange portion 12 and the tubular portion 13 are formed integrally in one-piece. It should be understood that the externally toothed portion 11, the flange portion 12 and the tubular portion 13 may be formed separately and joined together by, for example, welding.

Figure 4:
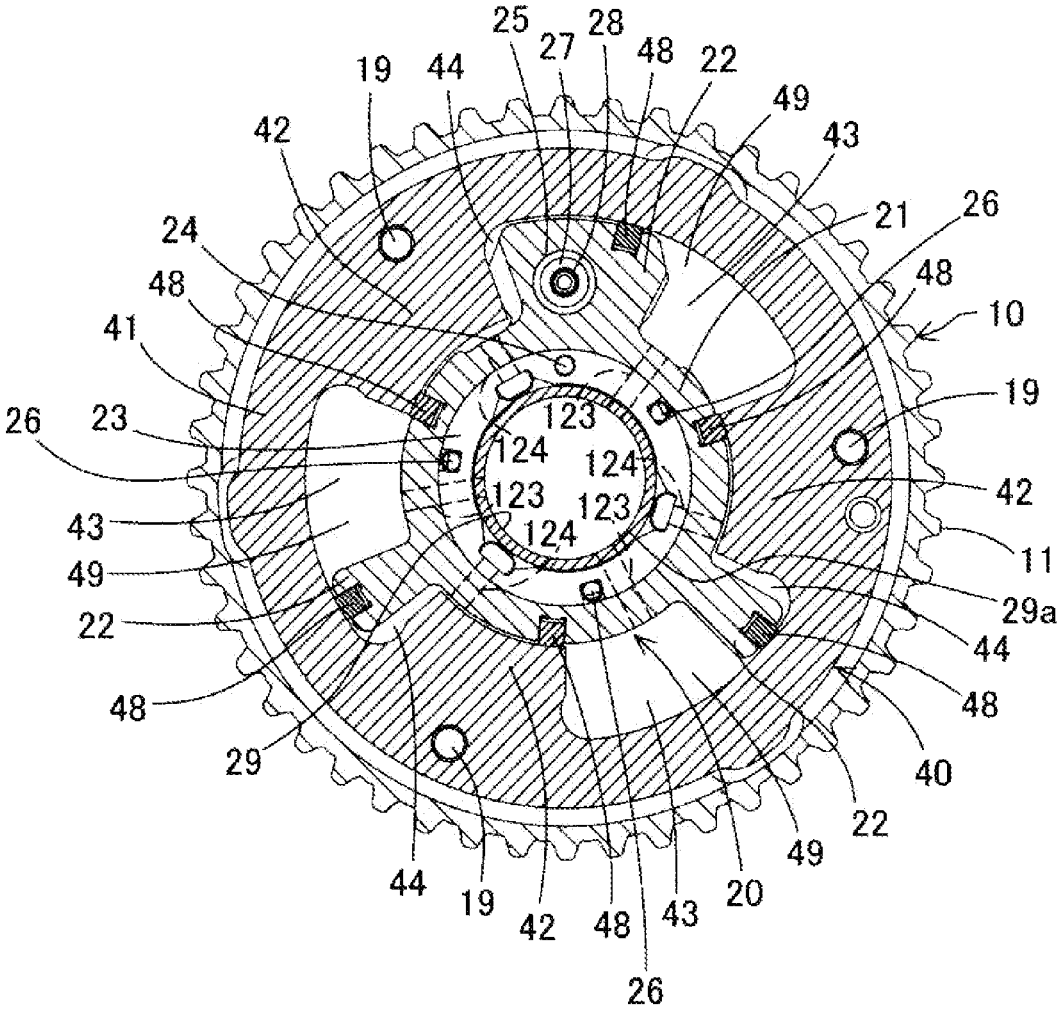
FIG. 4 is a cross-sectional view of the valve timing adjustment device taken along line IV-IV in FIG. 3.
Figure 5:
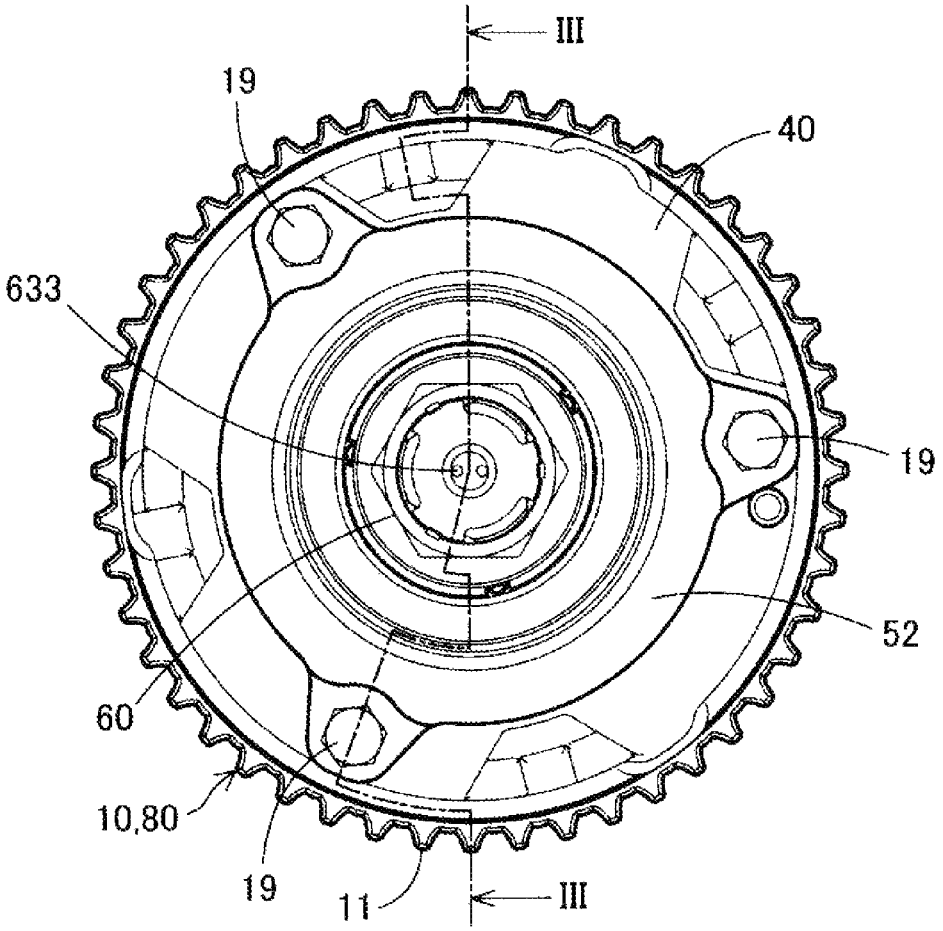
FIG. 5 is a front view of the valve timing adjustment device.
Figure 6:
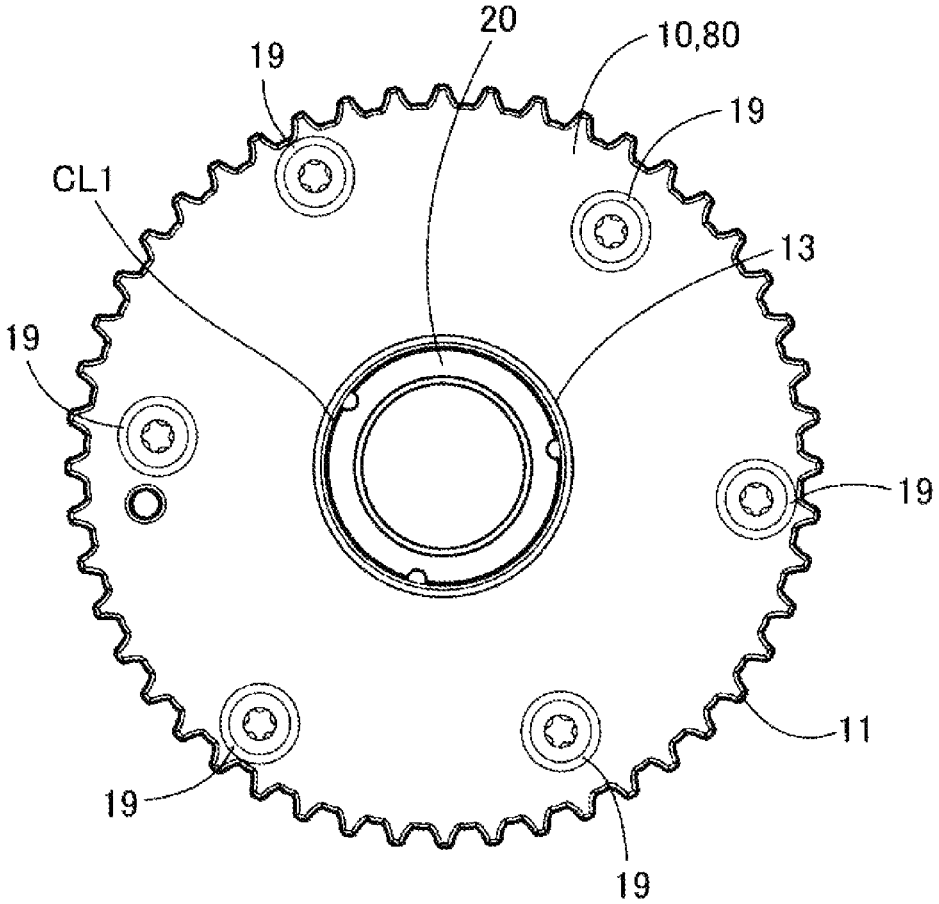
FIG. 6 is a rear view of the valve timing adjustment device.

As shown in FIGS. 1 and 4 to 6, the externally toothed portion 11 includes a plurality of teeth which outwardly project in a radial direction and are arranged one after another at predetermined intervals in a circumferential direction all around the externally toothed portion 11. The radial direction refers to a direction perpendicular to the axial direction CR in the present embodiment. FIG. 5 is a front view of the valve timing adjustment device 100 as seen from the solenoid device 70 side to the rear side. FIG. 6 is a rear view of the valve timing adjustment device 100 as seen from the camshaft 200 side to the front side.

The belt 300 is wound around the externally toothed portion 11 so that the externally toothed portion 11 receives the drive force of the crankshaft 4 through the belt 300. As shown in FIG. 3, a section (hereinafter referred to as a winding section) 111 of the externally toothed portion 11, around which the belt 300 is wound, is a front side section of the externally toothed portion 11 which is located at the front side. In other words, a location of the winding section 111 is at the front side along the externally toothed portion 11. Here, the term "location of the winding section 111" is defined as a location of a center of the winding section 111 which is centered in the axial direction CR. Furthermore, the winding section 111 is located on the front side of the vane rotor 20 when viewed in a direction perpendicular to the axial direction CR. The expression "located on the front side of the vane rotor 20" means that the center of the winding section 111, which is centered in the axial direction CR, is on the front side of a center of the vane rotor 20 which is centered in the axial direction CR.

The flange portion 12 is shaped in a circular disk form and is joined to a rear side end part of the externally toothed portion 11 and extends in the direction perpendicular to the axial direction CR. The tubular portion 13 is shaped in a tubular form and is coaxial with the externally toothed portion 11. The tubular portion 13 includes a receiving hole forming wall surface 131 that forms a receiving hole 132. A front side end part of the tubular portion 13 is joined to the flange portion 12. A through-hole extends through a center of the flange portion 12, and the tubular portion 13 is placed such that this through-hole is communicated with the receiving hole 132. The camshaft 200 is received in the receiving hole 132. A clearance (hereinafter referred to as a first clearance) CL1, which has a predetermined size, is formed between a wall surface (hereinafter referred to as a receiving hole forming wall surface) 131 of the receiving hole 132 and an outer peripheral surface of the camshaft 200. The first clearance CL1 forms a part of a discharge oil passage 91 described later. The rear cover 290 circumferentially entirely surrounds a rear side part of the tubular portion 13. A rear seal member 280 is placed between the tubular portion 13 and the rear cover 290. The rear seal member 280 limits leakage of the hydraulic oil through a gap between the tubular portion 13 and the rear cover 290.

[B2. Structure of Housing Vane]

As shown in FIG. 2, the housing vane 40 is shaped in a bottomed tubular form and has a through-hole at the bottom. As shown in FIG. 3, the housing vane 40 is received in an inside space of the pulley 10, i.e., a space of the pulley 10 formed on the radially inner side of the pulley 10 such that an opening of the housing vane 40 located on the rear side is opposed to a front side surface of the flange portion 12 of the pulley 10. A gap formed between a rear side end surface of the housing vane 40 and the front side end surface of the flange portion 12 is small, and a seal member 411 shaped in a ring form is placed in this gap to seal between the rear side end surface of the housing vane 40 and the front side end surface of the flange portion 12. The vane rotor 20 is received in an inside space of the housing vane 40, i.e., a space of the housing vane 40 formed on the radially inner side of housing vane 40. As shown in FIG. 2, the housing vane 40 includes a front wall 47 and a peripheral wall 41. The front wall 47 is shaped generally in a circular disk form. The front wall 47 is located at the most front side in the housing vane 40 and extends in the direction perpendicular to the axial direction CR. A through-hole forming portion 45, which forms a through-hole 46, is formed at a center of the front wall 47. The through-hole forming portion 45 is shaped in a tubular form. The peripheral wall 41 is shaped in a tubular form and projects from an outer periphery of the front wall 47 toward the rear side. As shown in FIG. 4, the peripheral wall 41 has a predetermined wall thickness in the radial direction and circumferentially extends all around the axis CX. The housing vane 40 further include three projections 42. Each projection 42 radially inwardly projects from the peripheral wall 41. In other words, a radial thickness of the peripheral wall 41 at each location, at which the corresponding projection 42 is formed, is increased. The three projections 42 are arranged at predetermined angular intervals (120 degree intervals) in the circumferential direction.

As described above, the housing vane 40 is arranged such that the rear side opening of the housing vane 40 is opposed to the front side surface of the flange portion 12, so that an inside space having a predetermined size is formed by the front wall 47, the peripheral wall 41, the projections 42 and the flange portion 12. The vane rotor 20 is received in this inside space. The remaining portion of this space, which is not occupied by the vane rotor 20, functions as a hydraulic chamber to be filled with the hydraulic oil. A location of the vane rotor 20 (three vanes 22 described later) in the circumferential direction is adjusted by using a pressure exerted in the hydraulic chamber. As described above, in the present embodiment, the housing vane 40 and the pulley 10 function as a housing member 80 which receives the vane rotor 20.

[B3. Structure of Vane Rotor]

As shown in FIGS. 2 and 4, the vane rotor 20 includes a rotor 21 and the three vanes 22. The rotor 21 is shaped generally in a cylindrical tubular form and includes a receiving hole 29 which extends through a center of the rotor 21 in the axial direction CR. An annular groove 23 is formed at a front side end surface of the rotor 21. The annular groove 23 is located adjacent to and on a radially outer side of a receiving hole forming portion 29*a*, which forms the receiving hole 29. As shown in FIG. 3, the vane rotor 20 is fixed to the camshaft 200 by the hydraulic oil control valve 60 and the bushing member 30. The vane rotor 20 rotates the camshaft 200 when the vane rotor 20 is rotated. As shown in FIG. 4, each vane 22 radially outwardly projects from the rotor 21. In other words, a radial thickness of the rotor 21 at each location, at which the corresponding vane 22 is formed, is increased. The three vanes 22 are arranged at predetermined angular intervals (120 degree intervals) in the circumferential direction. The vanes 22 partition the inside space of the housing member 80, which is formed by the front wall 47, the peripheral wall 41, the projections 42 and the flange portion 12, into a plurality of hydraulic chambers. Specifically, three hydraulic chambers 49, each of which is formed between adjacent two of the projections 42, are respectively partitioned by the three vanes 22 into a retard chamber 43 and an advance chamber 44. The hydraulic oil is supplied to or discharged from the retard chambers 43 through a plurality of retard oil passages 123 formed at the vane rotor 20. Similarly, the hydraulic oil is supplied to or discharged from the advance chambers 44 through a plurality of advance oil passages 124 formed at the vane rotor 20. The vane rotor 20 is rotated relative to the housing member 80 in response to the pressure of the hydraulic oil supplied to the retard chambers 43 and the advance chambers 44.

Seal members 48 are installed at the outer peripheral surface of the rotor 21 and the outer peripheral surfaces of the vanes 22. The seal members 48 limit flow of the hydraulic oil between the retard chambers 43 and the advance chambers 44 through a radial gap between each vane 22 and the peripheral wall 41 and a radial gap between the rotor 21 and each projection 42.

One of the three vanes 22 is larger than the other two of the vanes 22. This large vane 22 has a through-hole 25 which extends in parallel with the axial direction CR. A stopper pin 27 is received in the through-hole 25 such that the stopper pin 27 can reciprocate in the axial direction CR. As shown in FIG. 3, a recess is formed in the housing vane 40 at a location where the recess is opposed to the stopper pin 27 when the vane rotor 20 is placed in a most retarded position, and a ring member 413 is installed in this recess. A front side end part of the stopper pin 27 is inserted into an inner hole of the ring member 413 by an urging force of a spring 28 when the vane rotor 20 is placed in the most retarded position. Therefore, rotation of the vane rotor 20 relative to the housing member 80 is limited. This will limit, for example, generation of noise upon collision between the housing member 80 and the vane rotor 20 caused by torque fluctuation applied to the camshaft 200 at the time of engine start until the oil is supplied to the hydraulic chambers 49. A pressure chamber 414, which is communicated with the adjacent advance chamber 44, is formed around the stopper pin 27 in the vane rotor 20. When the pressure of the advance chambers 44 is increased, the hydraulic oil of the pressure chamber 414, which urges the stopper pin 27 toward the rear side, becomes larger than the urging force of the spring 28. Therefore, the distal end part of the stopper pin 27 is removed from the ring member 413. As a result, the rotation of the vane rotor 20 relative to the housing member 80 is enabled. The rotor 21 includes a plurality of discharge oil passage forming portions 26. Each of the discharge oil passage forming portions 26 is formed as a through-hole that extends through the rotor 21 in the axial direction CR. The discharge oil passage forming portions 26 form a part of the discharge oil passage 91 described later.

[B4. Structure of Bushing Member]

As shown in FIG. 2, the bushing member 30 is shaped in a cylindrical tubular form that has a through-hole extending in the axial direction CR. As shown in FIG. 3, the bushing member 30 is placed between the housing member 80 (the housing vane 40) and the hydraulic oil control valve 60 in the radial direction and rotatably supports the housing member 80. A rear side end part of the bushing member 30 is received in the annular groove 23 of the vane rotor 20 and is fixed to the vane rotor 20 by fixing pins 24 and an outer peripheral pressure. A remaining portion of the bushing member 30, which is other than the part of the bushing member 30 received in the annular groove 23, is received in the through-hole 46 of the housing vane 40. A radial clearance (a second clearance described later) is formed between an outer peripheral surface of the bushing member 30 and the through-hole forming portion 45 of the housing vane 40. Details of the second clearance will be described later. A portion (hereinafter referred to as a bearing section) 31 of the bushing member 30, which is received in the through-hole 46 and is opposed to the through-hole forming portion 45, functions as a bearing for rotatably supporting the housing member 80. A plurality of grooves 32 is formed to extend in the axial direction CR at the outer peripheral surface of the bearing section 31. The grooves 32 are arranged at predetermined angular intervals in the circumferential direction. Each groove 32 forms a part of the discharge oil passage 91 described later. In addition to the function of the bearing described above and the function of forming the part of the discharge oil passage 91, the bushing member 30 has a function of a seat surface for the hydraulic oil control valve 60 and a function of forming a part of the advance oil passage communicated with the advance chambers 44.

[B5. Structure of Front Plate]

As shown in FIGS. 2 and 3, the front plate 50 is shaped in a tubular form. The front plate 50 is located at the most front side in the valve timing adjustment device 100 and receives a front side end part of the hydraulic oil control valve 60. Furthermore, a front side end part of the front plate 50 is received in an inside (radially inner space) of the enclosing portion 73 of the solenoid device cover 72. The front plate 50 limits outflow of the leaked hydraulic oil, which is leaked through a gap between the housing member 80 and the bushing member 30 (between the through-hole forming portion 45 and the bearing section 31), to the outside of the valve timing adjustment device 100. The front plate 50 includes a tubular portion 51 and a flange portion 52. The tubular portion 51 and the flange portion 52 are formed integrally in one-piece. It should be understood that the tubular portion 51 and the flange portion 52 may be formed separately and joined together by, for example, welding. The tubular portion 51 is shaped in a tubular form and receives the front side end part of the hydraulic oil control valve 60 at an inner hole 53 which extends through the tubular portion 51 in the axial direction CR. The flange portion 52 is shaped in a circular disk form that has a through-hole at a center thereof. The flange portion 52 is joined to a rear side end part of the tubular portion 51. A rear side surface of the flange portion 52 contacts a front side surface of the front wall 47 of the housing vane 40. A seal member 412, which is shaped in a ring form, is placed between the front plate 50 and the housing vane 40. The seal member 412 seals a gap between a rear side end surface of the flange portion 52 and a front side end surface of the housing vane 40. As shown in FIG. 3, the pulley 10, the housing vane 40 and the front plate 50 are stacked one after another in the axial direction CR and are joined together by the bolts 19. In other words, the front plate 50 is located on the front side of the housing member 80 and is installed to the housing member 80 by the bolts 19.

As shown in FIG. 3, the front plate 50 includes a seal installation section 54 at an outer peripheral surface of a front side end part of the front plate 50, more specifically, a front side end part of the tubular portion 51. A front seal member 74 is installed on a radially outer side of the seal installation section 54. The front seal member 74 is shaped in a circular ring form, and an inner periphery of the front seal member 74 contacts the seal installation section 54 described above all around the seal installation section 54. Furthermore, an outer periphery of the front seal member 74 contacts an inner periphery of the enclosing portion 73 all around the enclosing portion 73. Thereby, the front seal member 74 limits leakage of the hydraulic oil through a gap between the front plate 50 and the solenoid device cover 72.

[B6. Structure of Hydraulic Oil Control Valve]

The hydraulic oil control valve 60 controls supply of the hydraulic oil to the hydraulic chambers 49 and discharge of the hydraulic oil from the hydraulic chambers 49. Furthermore, the hydraulic oil control valve 60 has a function of fixing member that fixes the vane rotor 20 to the camshaft 200. Before describing details of the structure of the hydraulic oil control valve 60 with reference to FIG. 7, the supply and discharge of the hydraulic oil relative to the valve timing adjustment device 100 will be schematically described.

As shown in FIG. 3, the hydraulic oil stored in the oil pan 500 is pumped up by the oil pump 510 and is supplied to a supply oil passage 250 through a through-hole 291, which is formed to extend in a thickness direction of the peripheral wall of the rear cover 290, and a through-hole 220, which is formed to extend in a thickness direction of the peripheral wall of the camshaft 200. The supply oil passage 250 is formed by a gap between an outer peripheral surface of the hydraulic oil control valve 60 and an inner peripheral surface of a receiving hole 201 at the front side end part of the camshaft 200. The hydraulic oil, which is supplied to the supply oil passage 250, is supplied to the hydraulic chambers 49 (the retard chambers 43 or the advance chambers 44) through the hydraulic oil control valve 60. Furthermore, a portion of the hydraulic oil, which is discharged from the hydraulic chambers 49, is discharged to the oil pan 500 through an inside of the hydraulic oil control valve 60 and a discharge hole 230 formed at an inside of the camshaft 200. Furthermore, a portion of the hydraulic oil from the advance chambers 44 and the hydraulic chambers 49 is temporarily accumulated in the accumulation space SP after flowing through the gap between the through-hole forming portion 45 of the housing vane 40 and the bearing section 31 of the bushing member 30. The accumulation space SP is a space, which is formed by the front plate 50, the solenoid device 70 and the solenoid device cover 72 to extend in the axial direction CR and accumulates the hydraulic oil. The hydraulic oil, which is accumulated in the accumulation space SP, is discharged to the oil pan 500 through the discharge oil passage 91 and a discharge hole 292 of the rear cover 290. The discharge oil passage 91 will be described in detail later. Furthermore, a portion of the hydraulic oil discharged from the hydraulic chambers 49 is discharged to the outside of the hydraulic oil control valve 60 through a discharge opening (a discharge opening 633) formed at the front side of the hydraulic oil control valve 60 and is then temporarily accumulated in the accumulation space SP.

Figure 7:
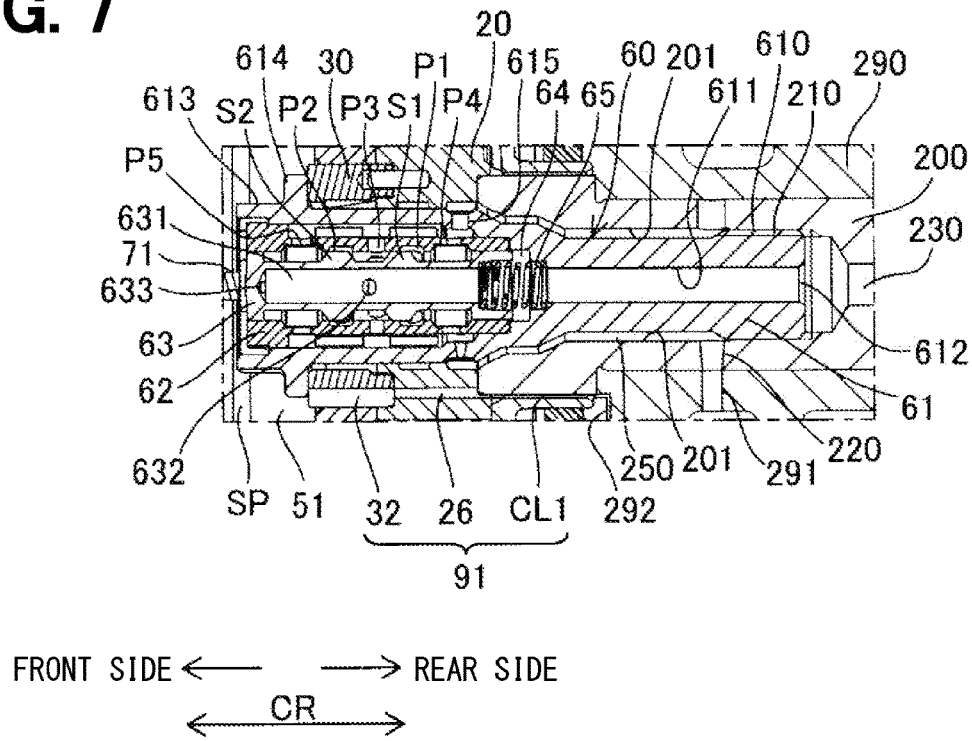
FIG. 7 is a cross-sectional view mainly showing a hydraulic oil control valve.

As shown in FIGS. 3 and 7, a rear side part of the hydraulic oil control valve 60, which is located on the rear side in the axial direction CR, is received in the receiving hole 201 of the camshaft 200. FIG. 7 is a cross-sectional view of a part of FIG. 3 around the hydraulic oil control valve 60. A center part of the hydraulic oil control valve 60, which is centered in the axial direction CR, is received in the receiving hole 29 of the vane rotor 20 and an inside space of the bushing member 30. A front side portion of the hydraulic oil control valve 60 is received in the inner hole 53 of the front plate 50. The hydraulic oil control valve 60 includes an outer sleeve 61, an inner sleeve 62 and a spool 63. The outer sleeve 61 and the inner sleeve 62 form a sleeve. The sleeve supports the spool 63 such that the spool 63 is movable in the axial direction CR, and the sleeve fixes the vane rotor 20 to the camshaft 200.

The outer sleeve 61 is shaped generally in a cylindrical tubular form and has a function of fixing the hydraulic oil control valve 60 to the camshaft 200, a function of receiving the inner sleeve 62 and the spool 63 and a function of forming the supply oil passage 250. A male threaded portion 610 is formed at an outer peripheral surface of a rear side end part of the outer sleeve 61. The male threaded portion 610 is threadably engaged with a female threaded portion 210 formed at a rear side end part of the receiving hole 201 of the camshaft 200. Thereby, the hydraulic oil control valve 60 is fixed to the camshaft 200. A tool engaging portion 613 is formed at a front side end part of the outer sleeve 61. The tool engaging portion 613 is shaped in an engageable form that can engage with a tool, such as a hexagonal wrench, and the tool engaging portion 613 is used to fix the hydraulic oil control valve 60 to the camshaft 200.

The outer sleeve 61 has a projection 614 which is formed at a location that is adjacent to and is on the rear side of the tool engaging portion 613. The projection 614 is shaped in a flange form and radially outwardly projects. When the hydraulic oil control valve 60 is fixed to the camshaft 200 by the tool engaging portion 613, the projection 614 is urged against a front side end surface of the bushing member 30. The hydraulic oil control valve 60 is positioned by threadably engaging the male threaded portion 610 to the female threaded portion 210 and urging the projection 614 against the bushing member 30. Furthermore, the hydraulic oil control valve 60 and the vane rotor 20 are fixed together when the bushing member 30 is urged by the projection 614 toward the rear side. Here, the hydraulic oil control valve 60 is fixed to the camshaft 200. Therefore, when the bushing member 30 is urged by the projection 614 toward the rear side, the camshaft 200 and the vane rotor 20 are fixed together through the bushing member 30 and the hydraulic oil control valve 60. A rear side end part of the receiving hole 201 of the camshaft 200 is communicated with the discharge hole 230. The outer sleeve 61 includes a plurality of hydraulic oil supply holes 615. The hydraulic oil supply holes 615 are respectively formed as a through-hole that extends through a peripheral wall of the outer sleeve 61 in a thickness direction thereof. The hydraulic oil supply holes 615 supply the hydraulic oil, which is supplied through the supply oil passage 250, to a space formed between the outer sleeve 61 and the inner sleeve 62. A receiving hole 64 and a discharge hole 611, which extend in the axial direction CR, are formed at the inside of the outer sleeve 61. A rear side end part of the receiving hole 64 and a front side end part of the discharge hole 611 are communicated with each other. Furthermore, a rear side end part of the discharge hole 611 and a front side end part of the discharge hole 230 are communicated with each other.

The inner sleeve 62 is shaped generally in a cylindrical tubular form and has a function of receiving the spool 63 and a function of providing ports for supplying the hydraulic oil to the vane rotor 20 and discharging the hydraulic oil from the vane rotor 20. The inner sleeve 62 is received in the receiving hole 64 of the outer sleeve 61. A through-hole, which extends in the axial direction CR, is formed at a radial center of the inner sleeve 62. A plurality of retard ports P1, a plurality of advance ports P2, a plurality of recycle ports P3, a plurality of retard supply ports P4 and a plurality of advance supply ports P5 are formed at the inner sleeve 62. These ports P1-P5 are respectively formed as a through-hole that extends through a peripheral wall of the inner sleeve 62 in a thickness direction thereof. The retard ports P1 are configured to communicate with the retard oil passages 123 of the vane rotor 20. Furthermore, the advance ports P2 are configured to communicate with the advance oil passages 124 of the vane rotor 20. The recycle ports P3 are ports for returning a portion of the hydraulic oil, which is discharged from the vane rotor 20, to the vane rotor 20. The retard supply ports P4 and the advance supply ports P5 are communicated with the hydraulic oil supply holes 615 of the outer sleeve 61.

The spool 63 is shaped in a bottomed tubular form and is received in the through-hole of the inner sleeve 62 such that the spool 63 is movable in the axial direction CR. A length of the spool 63 measured in the axial direction CR is shorter than a length of the receiving hole 64 measured in the axial direction CR. Therefore, the spool 63 can be moved from the position shown in FIG. 7 toward the rear side. A spring 65 is installed on the rear side of the spool 63. The spring 65 is a coil spring. A front side end part of the spring 65 contacts a rear side end part of the spool 63, and a rear side end part of the spring 65 contacts a step formed at the discharge hole 611 of the outer sleeve 61. The spring 65 urges the spool 63 toward the front side. A front side end part of the spool 63 contacts the push pin 71. When the push pin 71 is moved toward the rear side, the spool 63 is moved toward the rear side against the urging force of the spring 65. The state shown in FIGS. 3 and 7 is a state where the push pin 71 does not push the spool 63 toward the rear side.

A retard sealing portion 51 and an advance sealing portion S2 are formed at the outer peripheral surface of the spool 63. The retard sealing portion 51 and the advance sealing portion S2 both radially outwardly project and circumferentially extend all around the spool 63.

As shown in FIGS. 3 and 7, in the state where the push pin 71 does not push the spool 63 toward the rear side, the retard supply ports P4 and the retard ports P1 are communicated with each other. Furthermore, in this state, the advance sealing portion S2 seals between the advance supply ports P5 and the advance ports P2, so that the hydraulic oil is not supplied from the advance supply ports P5 to the advance ports P2. Furthermore, in this state, the advance ports P2 are communicated with the recycle ports P3. As described above, in the state shown in FIGS. 3 and 7, the hydraulic oil is supplied from the hydraulic oil control valve 60 to the retard chambers 43 through the retard oil passages 123 of the vane rotor 20, and the hydraulic oil is discharged from the advance chambers 44 through the advance oil passages 124 of the vane rotor 20. A portion of the discharged hydraulic oil is resupplied to the retard ports P1 through the recycle ports P3. Furthermore, another portion of the discharged hydraulic oil is discharged to the inner discharge hole 631 of the spool 63 through a through-hole 632. The portion of the discharged hydraulic oil, which is discharged to the inner discharge hole 631, is discharged to the outside through the discharge hole 611 and the discharge hole 230.

In contrast, in a state where the push pin 71 pushes the spool 63 toward the rear side, the retard sealing portion S1 seals between the retard supply ports P4 and the retard ports P1, so that the hydraulic oil is not supplied from the retard supply ports P4 to the retard ports P1. Furthermore, in this state, the advance supply ports P5 and the advance ports P2 are communicated with each other. Also, in this state, the retard supply ports P4 are communicated with the recycle ports P3. In such a state, the hydraulic oil is supplied from the hydraulic oil control valve 60 to the advance chambers 44 through the advance oil passages 124 of the vane rotor 20, and the hydraulic oil is discharged from the retard chambers 43 through the retard oil passages 123. A portion of the discharged hydraulic oil is supplied to the advance ports P2 through the recycle ports P3. Furthermore, another portion of the discharged hydraulic oil is discharged to the inner discharge hole 631 through the through-hole 632. The portion of the discharged hydraulic oil, which is discharged to the inner discharge hole 631, is discharged to the outside through the discharge hole 611 and the discharge hole 230.

Figure 8:
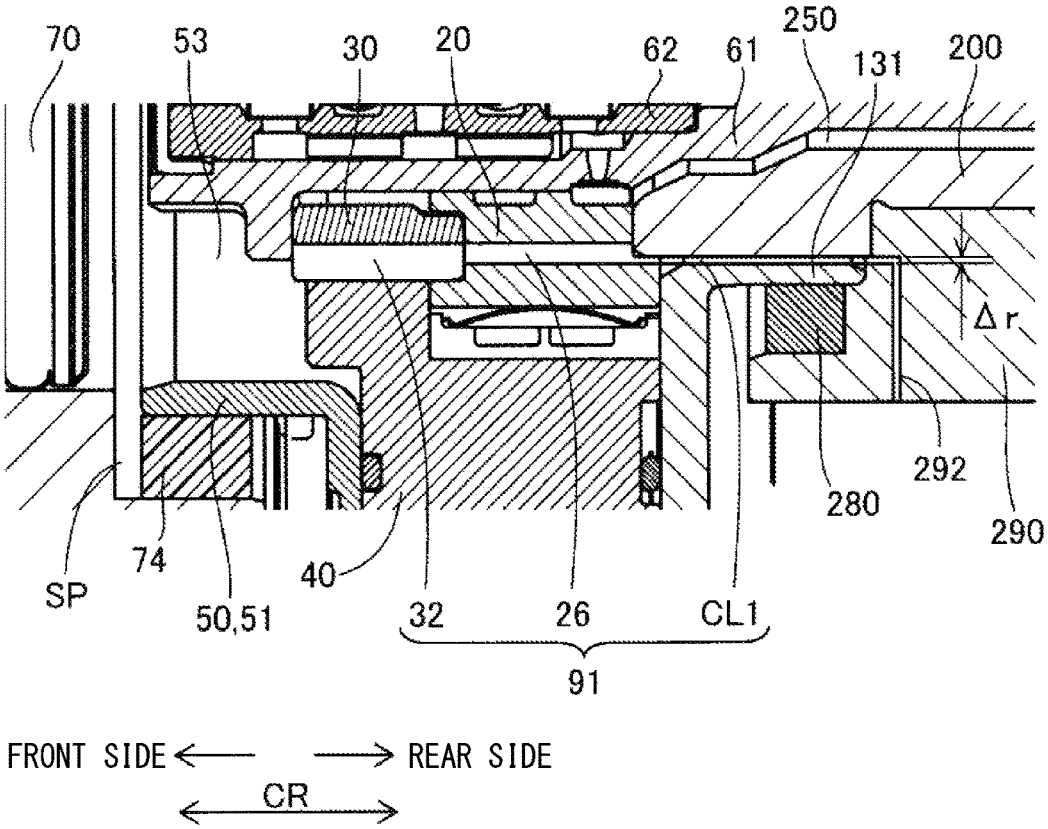
FIG. 8 is an enlarged cross-sectional view mainly showing a discharge oil passage.

As shown in FIGS. 1, 7 and 8, the discharge oil passage 91 is formed at the inside of the valve timing adjustment device 100. FIG. 8 shows, in an enlarged scale, a portion around the discharge oil passage 91 shown in FIG. 3. The grooves 32 of the bushing member 30, the discharge oil passage forming portions 26 of the vane rotor 20 and the first clearance CL1 between the receiving hole forming wall surface 131 and the outer peripheral surface of the camshaft 200 are communicated with each other in the axial direction CR to form the discharge oil passage 91. A front side end part of the discharge oil passage 91 is communicated with the accumulation space SP and the space (the inner hole 53) at the inside of the tubular portion 51 of the front plate 50. A rear side end part of the discharge oil passage 91 is communicated with the discharge hole 292 of the rear cover 290. A portion of the hydraulic oil from the advance chambers 44 and the hydraulic chambers 49 is temporarily accumulated in the accumulation space SP and the space (the inner hole 53) at the inside of the tubular portion 51 after flowing through the gap between the through-hole forming portion 45 of the housing vane 40 and the bearing section 31 of the bushing member 30. Although it is a small amount, a portion of the hydraulic oil, which is discharged from the hydraulic chambers 49 into the inner discharge hole 631 of the spool 63, is temporarily accumulated in the accumulation space SP and the space (the inner hole 53) at the inside of the tubular portion 51 after flowing through the discharge opening 633 formed at the front side end part of the spool 63 shown in FIG. 7. When the amount of the hydraulic oil accumulated in the accumulation space SP and the inner hole 53 is increased beyond a predetermined accumulation amount, the accumulated hydraulic oil is discharged to the outside through the discharge oil passage 91. As described above, since the portion of the discharge oil passage 91 is formed by the grooves 32 of the bearing section 31, the hydraulic oil, which flows in the grooves 32, can be used as the lubricating oil. Therefore, wearing of the bearing section 31 and the housing member 80 can be limited. Furthermore, since the portion of the discharge oil passage 91 is formed by the first clearance CL1, a machining process for forming the discharge oil passage 91 can be simplified, and the cost for forming the discharge oil passage can be reduced.

C. Positional Relationship Between Winding Section and Bearing Section

Figure 9:
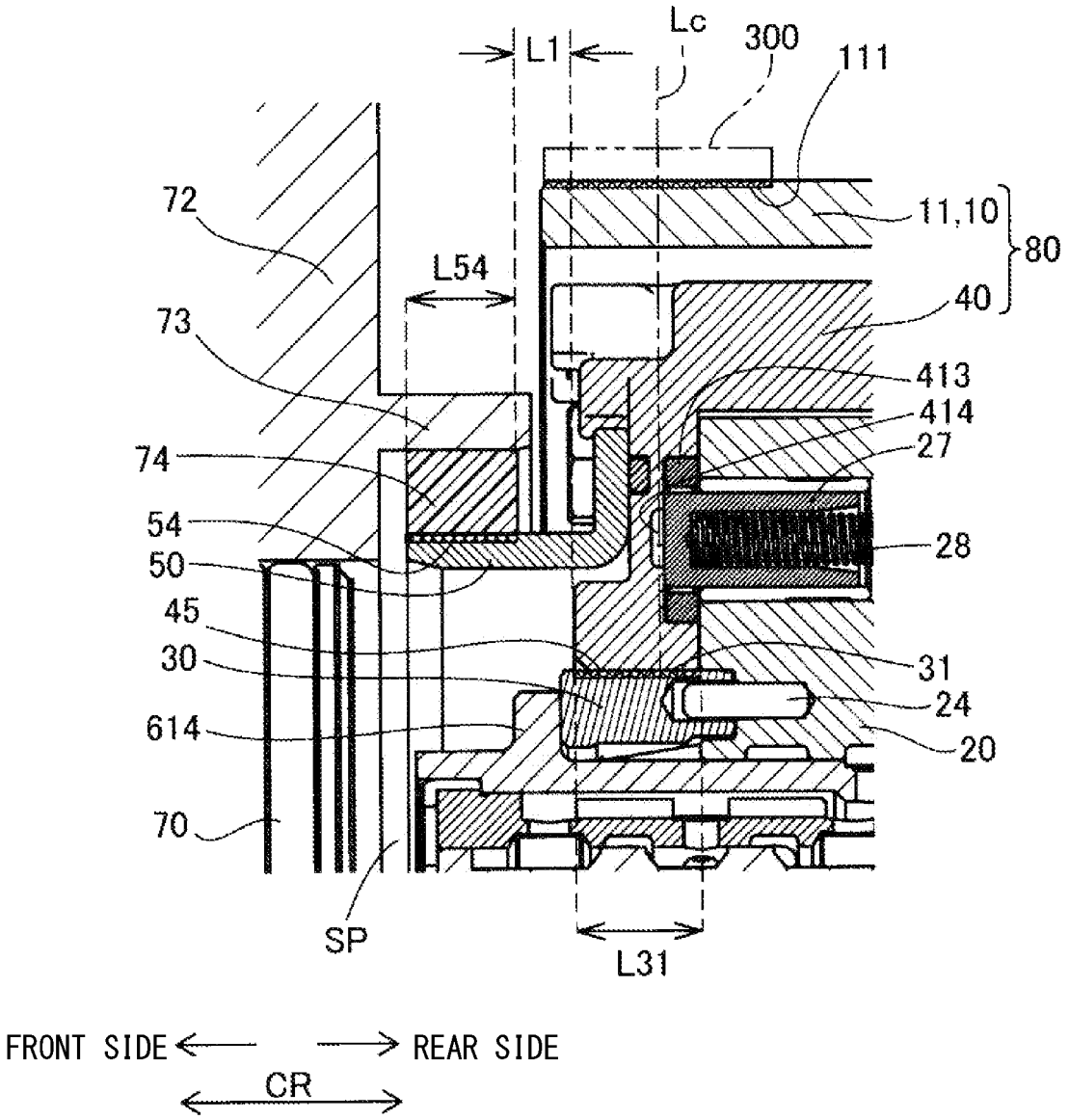
FIG. 9 is an enlarged cross-sectional view mainly showing a winding section, a seal installation section and a bearing section.

FIG. 9 shows, in an enlarged scale, a portion of FIG. 3 where the bushing member 30, the front seal member 74 and the winding section 111 are placed. As shown in FIG. 9, the bearing section 31 of the bushing member 30 and the winding section 111 of the externally toothed portion 11 partially overlap with each other when viewed in the direction (i.e., the radial direction) perpendicular to the axial direction CR. Specifically, the bearing section 31 entirely overlaps with the winding section 111 when viewed in the radial direction. Furthermore, a portion of the winding section 111, which is adjacent to a center of the winding section 111 that is centered in the axial direction CR, overlaps with the bearing section 31 when viewed in the radial direction. Therefore, as indicated by a dotted line Lc, the location of the center of the winding section 111, which is centered in the axial direction CR, overlaps with the bearing section 31 when viewed in the radial direction. In other words, the location of the center of the winding section 111, which is centered in the axial direction CR, is on the bearing section 31 when viewed in the radial direction. In contrast, two opposite end parts of the winding section 111, which are opposite to each other in the axial direction CR, do not overlap with the bearing section 31 when viewed in the radial direction. In the present disclosure, the expression of "partially overlap" means that a part of bearing section 31 and a part of the winding section 111 are placed at a corresponding location, or a projected figure of one of the bearing section 31 and the winding section 111, which is radially projected onto the other one of the bearing section 31 and the winding section 111, partially overlaps with the other one of the bearing section 31 and the winding section 111. Because of the above-described positional relationship between the bearing section 31 and the winding section 111, when a tension of the belt 300 is radially applied to the winding section 111, application of a force to the housing member 80 including the externally toothed portion 11 in a direction for tilting the housing member 80 can be limited. The direction for tilting the housing member 80 refers to, for example, a direction, in which an upper side of the drawing is tilted toward the rear side, and the lower side of the drawing is tilted toward the front side. If such a force is applied to the housing member 80 and the attitude of the housing member 80 is tilted, a thrust force in the axial direction CR will be applied from the housing member 80 to the housing vane 40. However, according to the present embodiment, the generation of such thrust force can be limited, so that generation of the frictional force between the housing member 80 and the vane rotor 20 can be limited, and thereby it is possible to limit a reduction in the response speed and an increase in the amount of wear of the housing member 80 and the vane rotor 20.

D. Positional Relationship Between Bearing Section and Seal Installation Section As shown in FIGS. 3 and 9, in the present embodiment, the bushing member 30 and the front seal member 74 are slightly spaced from each other when viewed in the direction perpendicular to the axial direction. Thus, the bearing section 31 and the seal installation section 54 are slightly spaced from each other when viewed in the direction perpendicular to the axial direction. However, a distance L1 between the bearing section 31 and the seal installation section 54 in the axial direction CR is very small. Specifically, the distance L1 is shorter than the length of the front seal member 74 measured in the axial direction CR, i.e., the seal length L54 of the seal installation section 54 measured in the axial direction CR. Furthermore, the distance L1 is shorter than the bearing length L31 which is a length of the bearing section 31 measured in the axial direction CR. As described above, the distance L1 between the bearing section 31 and the seal installation section 54 in the axial direction CR is very small, so that it is possible to limit an increase in the amount of radial runout (hereinafter referred to as the radial runout amount) of the front plate 50. The radial runout of the front plate 50 is a phenomenon of oscillating rotation of the front plate 50 that oscillates in the radial direction during the rotation of the front plate 50 resulting from presence of a dimensional tolerance of each corresponding component of the valve timing adjustment device 100 in the radial direction. Therefore, it is possible to limit wearing of the front seal member 74, and it is possible to limit the manufacturing costs of the valve timing adjustment device 100 by permitting large manufacturing variations (design tolerances) for each corresponding component of the housing member 80, namely the housing vane 40 and the pulley 10.

The bearing section 31 and the seal installation section 54 are both located on the front side of the location of the center of the housing member 80 which is centered in the axial direction CR.

E. Size of First Clearance

A size of the first clearance CL1, i.e., a size that is twice larger than a size Δr of a gap (a size Δr of a gap per a radius) between the receiving hole forming wall surface 131 and the outer peripheral surface of the camshaft 200 shown in FIG. 8 is equal to or larger than a sum of a size of the second clearance and a size of a third clearance described later. The second clearance is a gap between the housing member 80 (the housing vane 40) and the bearing section 31 of the bushing member 30 in the radial direction, i.e., a gap per a diameter. The gap (the second clearance) is formed between the housing vane 40 and the bearing section 31 to such an extent that the bearing section 31 can slidably support the housing member 80, and the bearing section 31 and the housing member 80 can slide relative to each other.

Figure 10:
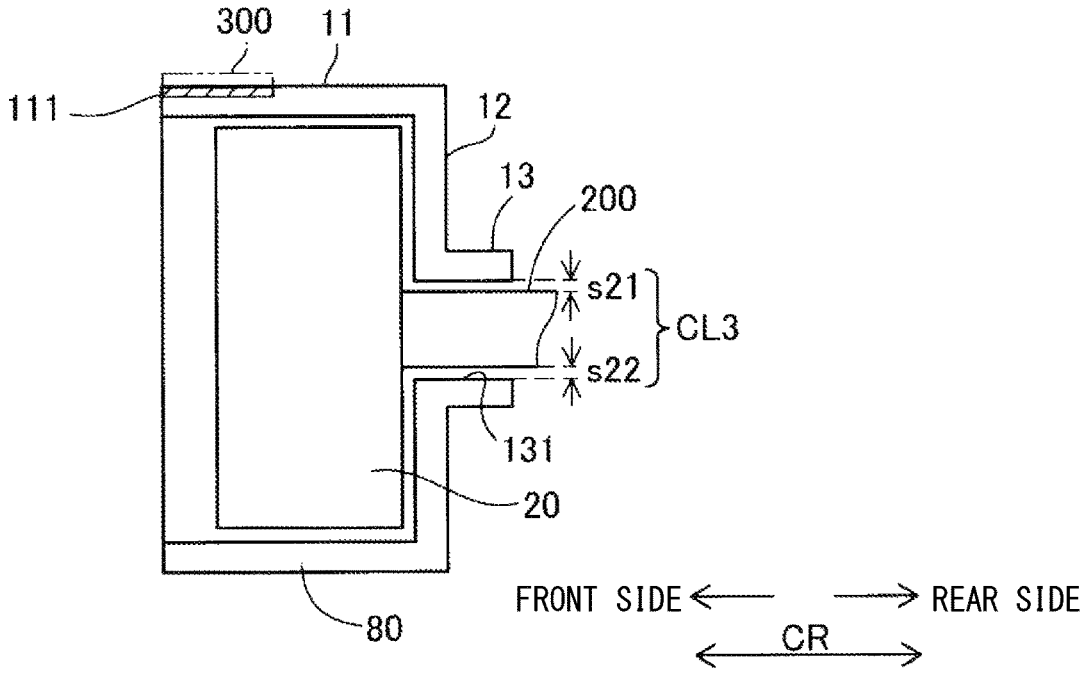
FIG. 10 is a schematic diagram showing a vane rotor, a housing member and a camshaft in a state where a tension of a belt is not applied to the winding section.
Figure 11:
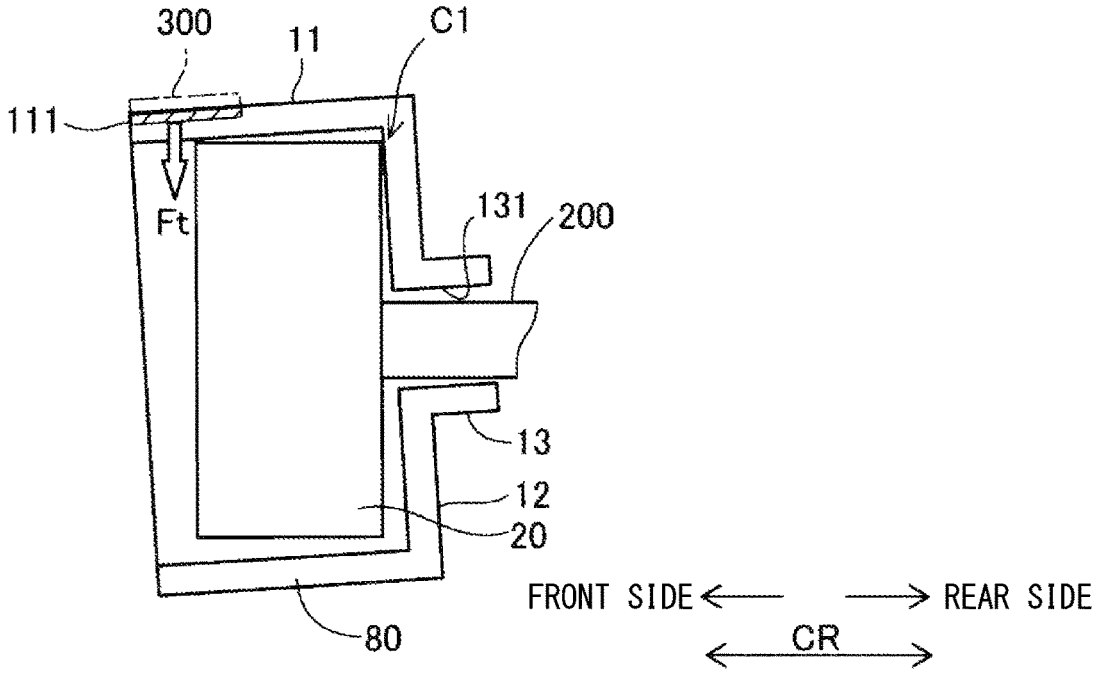
FIG. 11 is a schematic diagram showing the vane rotor, the housing member and the camshaft in a state where the tension of the belt is applied to the winding section.

The third clearance will be described with reference to FIGS. 10 and 11. FIG. 10 schematically indicates the vane rotor 20, the housing member 80 and the camshaft 200 in a state where the tension of the belt 300 is not applied to the winding section 111. Furthermore, FIG. 11 indicates the vane rotor 20, the housing member 80 and the camshaft 200 in a state where the tension of the belt 300 is applied to the winding section 111. In FIGS. 10 and 11, the size of the gap between the camshaft 200 and the tubular portion 13 (the receiving hole forming wall surface 131) is different from the size of the first clearance CL1 but is the size of the third clearance CL3.

In the example shown in FIG. 10, the third clearance CL3 is a composite gap that combines two gaps s21, s22 between the outer peripheral surface of the camshaft 200 and the receiving hole forming wall surface 131 of the tubular portion 13. In the state of FIG. 10, when the tension Ft of the belt 300 is applied to the winding section 111, the housing member 80 may possibly tilt relative to the vane rotor 20 as shown in FIG. 11 even in the case where the positional relationship between the winding section 111 and the bearing section 31 is the above-described positional relationship. In FIG. 11, the housing member 80 is schematically indicated in the state where the housing member 80 is most tilted. The expression of "most tilted" means that as a result of the tilting of the housing member 80, as shown in FIG. 11, a rear side upper end part Cl of the vane rotor 20 touches the inner wall of the housing member 80 and cannot be tilted any further. As shown in FIG. 11, even in this state, the receiving hole forming wall surface 131 of the tubular portion 13 and the outer peripheral surface of the camshaft 200 do not contact with each other. This state can be achieved by adjusting at least one of al size of the tubular portion 13 measured in the radial direction and a size of the camshaft 200 measured in the radial direction. It is possible to further limit the contact between the receiving hole forming wall surface 131 and the outer peripheral surface of the camshaft 200 in the most tilted state of the housing member 80 by adjusting at least one of the size of the tubular portion 13 measured in the radial direction and the size of the camshaft 200 measured in the radial direction such that a difference between the size of the tubular portion 13 measured in the radial direction and the size of the camshaft 200 measured in the radial direction is increased. In contrast, when at least one of the size of the tubular portion 13 measured in the radial direction and the size of the camshaft 200 measured in the radial direction is adjusted such that the difference between the size of the tubular portion 13 measured in the radial direction and the size of the camshaft 200 measured in the radial direction is decreased, there is an increased possibility that the receiving hole forming wall surface 131 and the outer peripheral surface of the camshaft 200 contact with each other in the most tilted state of the housing member 80. In the present embodiment, there is obtained a minimum difference, which is between the size of the tubular portion 13 measured in the radial direction and the size of the camshaft 200 measured in the radial direction and is required to limit the contact between the receiving hole forming wall surface 131 and the outer peripheral surface of the camshaft 200 in the most tilted state of the housing member 80, and this difference is specified as the size of the third clearance CL3.

As described above, the size of the first clearance CL1 is set to be equal to or larger than the sum of the size of the second clearance and the size of the third clearance. Therefore, even when the relative position between the housing member 80 and the bearing section 31 deviates in the radial direction by the amount of the clearance (the second clearance) between the housing member 80 and the bearing section 31, contact between the camshaft 200 and the housing member 80 can be limited. Also, when the housing member 80 is tilted relative to the vane rotor 20 in response to the application of the tension of the belt 300 to the winding section 111, it is possible to limit contact between the camshaft 200 and the housing member 80.

In addition, due to the provision of the first clearance CL1, the outer peripheral surface of the front side end part of the camshaft 200 does not need to function as a bearing for rotatably supporting the housing member 80. Therefore, it is possible to limit that the bearing for rotatably supporting the housing member 80 does not overlap with the winding section 111 when viewed in the direction perpendicular to the axial direction CR.

As described above, according to the valve timing adjustment device 100 of the present embodiment, the bearing section 31 and the winding section 111 overlap with each other when viewed in the direction perpendicular to the axial direction CR. Thus, it is possible to limit the application of the force to the housing member 80 in the direction for tilting the housing member 80 when the tension of the belt 300 is applied to the winding section 111. As a result, it is possible to limit the generation of the thrust force between the housing member 80 and the vane rotor 20.

Furthermore, the location of the winding section 111 at the externally toothed portion 11 and the location of the bearing section 31 are both at the front side, so that it is possible to limit the occurrence of the radial runout at the front side part of the valve timing adjustment device 100. Thus, it is possible to limit the wearing of the front seal member 74 caused by the radial runout of the front side part of the valve timing adjustment device 100.

Furthermore, since the valve timing adjustment device 100 includes the bushing member 30 that has the bearing section 31, the structure of the vane rotor 20 can be simplified in comparison to a structure in which a portion of the vane rotor 20 is used as the bearing section. Therefore, the vane rotor 20 can be easily manufactured and assembled.

Furthermore, since the hydraulic oil control valve 60 is used as the fixing member for fixing the vane rotor 20 to the camshaft 200, the number of the components can be reduced in comparison to a structure in which the fixing member and the hydraulic oil control valve are respectively formed as separate members. Therefore, the size of the valve timing adjustment device 100 can be reduced.

Furthermore, since the bearing section 31 of the bushing member 30 has the grooves 32 which form the part of the discharge oil passage 91, the hydraulic oil, which passes the grooves 32, can be used as the lubricating oil. Therefore, the wearing of the bearing section 31 and the housing member 80 can be limited.

Furthermore, since the first clearance CL1, which is formed between the receiving hole forming wall surface 131 for forming the receiving hole 132 at the housing member 80 (the pulley 10) and the outer peripheral surface of the camshaft 200, forms the part of the discharge oil passage 91, the machining process for forming the discharge oil passage 91 can be simplified, and the costs of forming the discharge oil passage can be reduced.

Furthermore, the distance L1 between the bearing section 31 and the seal installation section 54 in the axial direction CR is shorter than the seal length L54 and the bearing length L31. As a result, it is possible to limit an increase in the radial runout amount of the front plate 50 resulting from the presence of the dimensional tolerance of each corresponding component of the valve timing adjustment device 100 in the radial direction.

Furthermore, the size of the first clearance CL1 is set to be equal to or larger than the sum of the size of the second clearance and the size of the third clearance. Therefore, it is possible to limit the contact between the camshaft 200 and the housing member 80 even when the location of the contact between the housing member 80 and the bearing section 31 deviates in the radial direction. Furthermore, it is possible to limit the contact between the camshaft 200 and the housing member 80 even when the housing member 80 is tilted relative to the vane rotor 20 in response to the application of the tension of the belt 300 to the winding section 111. Thereby, it is possible to limit the wearing of the housing member 80 and the vane rotor 20, and it is possible to limit the reduction in the response speed of the valve timing adjustment device 100.

F. Other Embodiments

[F1] The positional relationship between the winding section 111 and the bearing section 31 should not be limited to the positional relationship of the above embodiment. For example, the location of the center of the winding section 111 in the axial direction CR may not overlap with the bearing section 31 (may not locate on the bearing section 31) when viewed in the direction (the radial direction) perpendicular to the axial direction. However, even in this structure, when an axial portion of the winding section 111 in the axial direction CR overlaps with the bearing section 31, the advantages of the above embodiment can be achieved. Furthermore, for example, in a structure where the length of the winding section 111 measured in the axial direction CR and the length of the bearing section 31 measured in the axial direction CR are equal to each other, the bearing section 31 and the winding section 111 may completely overlap with each other when viewed in the radial direction. Furthermore, unlike the above embodiment, the length of the winding section 111 (the belt 300) measured in the axial direction CR may be shorter than the length of the bearing section 31 measured in the axial direction CR. In such a case, when viewed in the radial direction, the winding section 111 may entirely overlap with the bearing section 31, and only a part of the bearing section 31 overlaps with the winding section 111. Specifically, in general, the valve timing adjustment device 100 of the present disclosure may have the structure in which the bearing section 31 and the winding section 111 at least partially overlap with each other when viewed in the direction perpendicular to the axial direction CR.

[F2] The positional relationship between the bearing section 31 and the seal installation section 54 should not be limited to the positional relationship of the above embodiment. For example, the distance L1 may be longer than one of the seal length L54 and the bearing length L31. Even in this structure, when the distance L1 is shorter than the sum of the seal length L54 and the bearing length L31, the advantages of the above embodiment can be achieved. Particularly, it is preferred that the distance L1 is zero. This structure means that the seal installation section 54 and the winding section 111 are adjacent to each other or overlap with each other when viewed in the direction perpendicular to the axial direction CR. With this structure, the increase in the radial runout amount can be more reliably limited. Furthermore, the distance L1 may be equal to or longer than the sum of the seal length L54 and the bearing length L31. Even in this structure, it is desirable that the bearing section 31 and the seal installation section 54 are both located on the front side of the location of the center of the housing member 80 which is centered in the axial direction CR. Even in this structure, it is possible to reduce the distance L1 in comparison to the case where one of the seal installation section 54 and the bearing section 31 is located on the front side of the center of the housing member 80, which is centered in the axial direction CR, and the other one of the seal installation section 54 and the bearing section 31 is located on the rear side of the center of the housing member 80 which is centered in the axial direction CR. Alternatively, both of the seal installation section 54 and the bearing section 31 may be located on the rear side of the center of the housing member 80 which is centered in the axial direction CR.

[F3] In the above embodiment, the location of the winding section 111 along the externally toothed portion 11, more specifically, the location of the center of the winding section 111, which is centered in the axial direction CR, is at the front side along the externally toothed portion 11. However, the present disclosure should not be limited to this. The location of the winding section 111 may be at the rear side along the externally toothed portion 11. Furthermore, the location of the winding section 111 may be a location that coincides with the location of the center of the externally toothed portion 11 in the axial direction CR.

[F4] In the above embodiment, the winding section 111 is located on the front side of the vane rotor 20 when viewed in the direction perpendicular to the axial direction CR. However, the present disclosure should not be limited to this. The winding section 111 may be at the same location as the vane rotor 20 or may be on the rear side of the vane rotor 20 when viewed in the direction perpendicular to the axial direction CR. The expression "the same location as the vane rotor 20" means that the center of the winding section 111, which is centered in the axial direction CR, coincides with the location of the center of the vane rotor 20 which is centered in the axial direction CR. Furthermore, the expression "on the rear side of the vane rotor 20" means that the center of the winding section 111, which is centered in the axial direction CR, is located on the rear side of the location of the center of the vane rotor 20 which is centered in the axial direction CR.

[F5] In the above embodiment, the bushing member 30 may be eliminated. In such a structure, for example, the annular groove 23 may be eliminated from the vane rotor 20, and a projection may be formed at the vane rotor 20 such that the projection projects toward the front side contrary to the annular groove 23, and this projection may be used as a bearing for rotatably supporting the housing member 80. In this structure, the portion of the vane rotor 20, which is radially opposed to the through-hole forming portion 45 of the housing member 80 (the housing vane 40), corresponds to the sub-concept of the bearing section of the present disclosure.

[F6] In the above embodiment, the hydraulic oil control valve 60 is used as the fixing member for fixing the vane rotor 20 to the camshaft 200. However, the present disclosure should not be limited to this. A bolt may be used as the fixing member in place of the hydraulic oil control valve 60. In this structure, a thread of the bolt may be threadably engaged with the female threaded portion 210 of the camshaft 200, and a head of the bolt may urge the bushing member 30 toward the rear side. Furthermore, in this structure, the hydraulic oil control valve may be installed at a location that is different from the location of the camshaft 200, and a hydraulic oil passage, which communicates the hydraulic oil control valve to the retard oil passages 123 and the advance oil passages 124, may be formed at least a part of the rear cover 290, the camshaft 200 and the bolt.

[F7] In the above embodiment, another oil passage for discharging the hydraulic oil from the accumulation space SP may be formed in place of the discharge oil passage 91. For example, a hole, which communicates between the accumulation space SP and the outside space, may be formed at the solenoid device cover 72, and this hole may be used as an oil passage for discharging the hydraulic oil. Furthermore, in this structure, the size of the first clearance CL1 may be set to be smaller than the sum of the size of the second clearance and the size of third clearance CL3.

[F8] The structure of the valve timing adjustment device 100 of the above embodiment is only an example and may be changed in various ways. For example, any type of transmission member, such as a timing chain, which can transmit the drive force from the crankshaft 4 toward the camshaft 200, may be used in place of the belt 300. Furthermore, the valve timing adjustment device 100 may be used to adjust a valve timing of the exhaust valves 2. Furthermore, the number and arrangement angle of the projections 42 in the housing vane 40 may not be limited to three and 120 degrees but may be any number and angle. Similarly, the number and arrangement angle of the vanes 22 in the vane rotor 20 may not be limited to three and 120 degrees but may be any number and angle.

The present disclosure should not be limited to the above-described embodiment and can be realized in various structures without departing from the principle of the present disclosure. For example, the technical features of each embodiment, which corresponds to the technical features in the summary section of the present disclosure, may be replaced or combined as appropriate to address some or all of the disadvantages described above or to achieve some or all of the advantages described above. If the technical feature is not described as essential in the specification, it can be deleted as appropriate.

What is claimed is:

1. A valve timing adjustment device configured to be fixed to an end part of a driven shaft to adjust a valve timing of a valve by adjusting a relative rotational phase of the driven shaft relative to a drive shaft, wherein the driven shaft is configured to receive a drive force from the drive shaft to open and close the valve, the valve timing adjustment device comprising:

a housing member that has an inside space and is configured to receive the drive force from the drive shaft;

a vane rotor that includes at least one vane which partitions the inside space into a plurality of hydraulic chambers, wherein the vane rotor is securely coupled to the driven shaft and is configured to rotate relative to the housing member when the vane rotor receives a pressure of hydraulic oil introduced into at least one of the plurality of hydraulic chambers;

a fixing member that fixes the vane rotor to the driven shaft; and a bearing section that is placed between the housing member and the fixing member in a radial direction and rotatably supports the housing member, wherein:

the housing member includes a winding section that is formed at an outer peripheral surface of the housing member, wherein a transmission member, which is configured to transmit the drive force from the drive shaft toward the driven shaft, is wound around the winding section; and the bearing section entirely overlaps with a portion of the winding section around which the transmission member is directly wound when viewed in a direction perpendicular to an axial direction of the fixing member.

2. The valve timing adjustment device according to claim 1, wherein among a rear side, which is a side of the valve timing adjustment device where the driven shaft is placed in the axial direction, and a front side, which is another side of the valve timing adjustment device opposite to the rear side in the axial direction, a location of the winding section is at the front side along the outer peripheral surface.

3. The valve timing adjustment device according to claim 2, wherein the winding section is placed on the front side of the vane rotor in the axial direction when viewed in the direction perpendicular to the axial direction.

4. The valve timing adjustment device according to claim 1, further comprising a bushing member that is placed between the fixing member and the housing member in the radial direction, wherein the bushing member includes the bearing section.

5. The valve timing adjustment device according to claim 1, wherein the fixing member is a hydraulic oil control valve that controls flow of the hydraulic oil and includes:

a spool which is configured to be driven by a solenoid device in the axial direction; and a sleeve which supports the spool such that the spool is movable in the axial direction, wherein the sleeve is securely placed to fix the vane rotor to the driven shaft.

6. The valve timing adjustment device according to claim 5, further comprising a bushing member that is placed between the fixing member and the housing member in the radial direction, wherein:

the bushing member includes the bearing section;

when a solenoid device cover is installed to the solenoid device, an accumulation space for accumulating the hydraulic oil leaked from at least one of the bearing section and an inside of the hydraulic oil control valve is formed between the solenoid device cover and the housing member in the axial direction; and a groove, which forms a part of a discharge oil passage for discharging the hydraulic oil by communicating between the accumulation space and an outside space, is formed at the bearing section of the bushing member.

7. The valve timing adjustment device according to claim 6, wherein:

the housing member includes a receiving hole which extends in the axial direction and through which the driven shaft extends;

a first clearance is formed between a receiving hole forming wall surface of the housing member, which forms the receiving hole, and an outer peripheral surface of the driven shaft; and the first clearance forms a part of the discharge oil passage.

8. The valve timing adjustment device according to claim 7, wherein a size of the first clearance is equal to or larger than a sum of:

a size of a second clearance between the housing member and the bearing section; and a size of a third clearance that is a minimum clearance, which is located between the outer peripheral surface of the driven shaft and the receiving hole forming wall surface and is required to limit contact of the driven shaft to the receiving hole forming wall surface when the housing member is most tilted relative to the vane rotor.

9. The valve timing adjustment device according to claim 6, further comprising a front plate, wherein:

among a rear side, which is a side of the valve timing adjustment device where the driven shaft is placed in the axial direction, and a front side, which is another side of the valve timing adjustment device opposite to the rear side in the axial direction, the front plate is located on the front side of the housing member and is installed to the housing member to face the accumulation space;

the front plate includes a seal installation section, wherein a seal member for limiting leakage of the hydraulic oil through a gap between the front plate and the solenoid device cover is installed to the seal installation section; and the seal installation section and the bearing section are both located on the front side of a center of the housing member which is centered in the axial direction.

10. The valve timing adjustment device according to claim 9, wherein the seal installation section and the bearing section are adjacent to each other or overlap with each other when viewed in the direction perpendicular to the axial direction.

11. The valve timing adjustment device according to claim 9, wherein a distance between the seal installation section and the bearing section measured in the axial direction is shorter than a sum of a seal length, which is a length of the seal installation section measured in the axial direction, and a bearing length, which is a length of the bearing section measured in the axial direction.

* * * * *